United States Patent [19]

Collins et al.

[11] 4,030,327

[45] June 21, 1977

[54] SPRING COILING MACHINE WITH IMPROVED DRIVE MEANS

[75] Inventors: Charles P. Collins, Torrington; Bernard P. Lampietti, Goshen, both of Conn.

[73] Assignee: Torin Corporation, Torrington, Conn.

[22] Filed: June 16, 1976

[21] Appl. No.: 696,777

[52] U.S. Cl. ..... 72/23; 72/27; 72/131; 72/140

[51] Int. Cl.[2] ..... B21F 3/02; B21F 35/00

[58] Field of Search ..... 72/21–23, 72/26, 27, 129, 131, 132, 135, 138, 140, 145

[56] References Cited

UNITED STATES PATENTS

| | | | |
|---|---|---|---|
| 2,149,942 | 3/1939 | Prentice | 72/27 |
| 2,455,863 | 12/1948 | Halvorsen | 72/131 |
| 2,902,079 | 9/1959 | Costello et al. | 72/131 |
| 2,923,343 | 2/1960 | Franks | 72/131 |
| 3,010,491 | 11/1961 | Pearson | 72/129 |
| 3,402,584 | 9/1968 | Cavagnero | 72/132 |
| 3,610,006 | 10/1971 | Scheublein et al. | 72/138 |
| 3,740,984 | 6/1973 | Bergevin | 72/131 |
| 3,906,766 | 9/1975 | Sato | 72/138 |
| 3,934,445 | 1/1976 | Lampietti | 72/129 |

*Primary Examiner*—E. M. Combs
*Attorney, Agent, or Firm*—McCormick, Paulding & Huber

[57] ABSTRACT

A spring coiling machine with an improved drive means has a pair of feed rolls for advancing wire from a source of supply to a coiling station. Coiling tools at the station obstruct feed movement and form coil springs and a cut-off tool successively severs the springs. The coiling tools and cut-off tool are operated from a camshaft driven by a first electric motor and a second electric motor drives the feed rolls. Continuous rotation for both camshaft and feed rolls is provided by the electric motors and a mechanism operated by the camshaft lifts an upper feed roll to terminate feed roll gripping action on the wire and to thus terminate wire feed at the completion of each spring. The first or camshaft motor serves as a lead motor and the feed roll motor as a follower. A digital feedback from the first motor is introduced to the control system therefor and also as an input to a second control system for the feed roll motor. The second motor also has its own digital feedback and a "ratio set" input is provided through its control system thus accommodating manual selection of motor speed ratio and selection of wire feed length and spring configuration.

18 Claims, 2 Drawing Figures

SPRING COILING MACHINE WITH IMPROVED DRIVE MEANS

BACKGROUND OF THE INVENTION

The present invention relates to the type of spring coiling machine wherein wire is fed intermittently from a source of supply along a longitudinal path and is coiled during the feeding operation by a coiling tool or abutment to form springs, cut-off occurring at the end of each wire feeding and coiling operation. While not necessarily so limited, the invention is particularly applicable to spring coiling machines of the general type shown in:

U.S. Pat. No. 2,199,002 issued May 31, 1938 to Bergevin and Nigro.

U.S. Pat. No. 2,455,863 issued Dec. 7, 1948 to E. W. Halvorsen.

U.S. Pat. No. 2,820,505 issued Jan. 21, 1958 to E. E. Franks et al.

U.S. Pat. No. RE-24,345 issued Aug. 20, 1957 to C. R. Bergevin.

U.S. Pat. No. 2,902,079 issued Sept. 1, 1959 to Costello et al.

U.S. Pat. No. 2,923,343 issued Feb. 2, 1960 to Franks.

U.S. Pat. No. 2,925,115 issued Feb. 16, 1960 to Franks.

U.S. Pat. No. 3,009,505 issued Nov. 21, 1961 to Franks.

U.S. Pat. No. 3,068,927 issued Dec. 18, 1962 to Bergevin.

U.S. Pat. No. 3,402,584 issued Sept. 24, 1968 to Cavagnero.

U.S. Pat. No. 3,934,445 issued Jan. 27, 1976 to Lampietti.

More particularly, the invention relates to improved drive means for spring coiling machines of the general type mentioned. Prior art spring coiling machines fall into two general categories, the "segment type" and the "clutch type". Segment type coilers are noted for a high degree of accuracy and repeatability in spring coiling operations but such machines are found somewhat lacking in flexibility. That is, during set up operations, the use of change gears is necessary when it is desired to change spring configuration and wire feed length over a wide range. Further, it will be obvious that feed length cannot be changed "on the run". Still further, severe limitations are encountered in a relative amount or degree of cyclic time available for feeding, coiling and cut-off operations.

In the case of "clutch type" spring coiling machines some improvement in machine flexibility and versatility is achieved. That is, severe limitations on the ability to change the length of wire feed are overcome and set-up operations are somewhat less onerous. Such machines, however, are not wholly satisfactory. Their accuracy and repeatability are found somewhat lacking and in the present state of the art they are inferior in this respect to "segment type" spring coiling machines.

The present invention incorporates the best features of both "segment type" and "clutch type" spring coiling machines.

SUMMARY OF THE INVENTION

It is the general object of the present invention to provide a spring coiling machine having an improved drive means which endows the machine with a high degree of accuracy and repeatability in the production of coil springs and which yet imposes no severe limitations on machine flexibility and versatility, instead enhancing these characteristics of the machine.

DESCRIPTION OF THE PREFERRED EMBODIMENT

Figure 1:
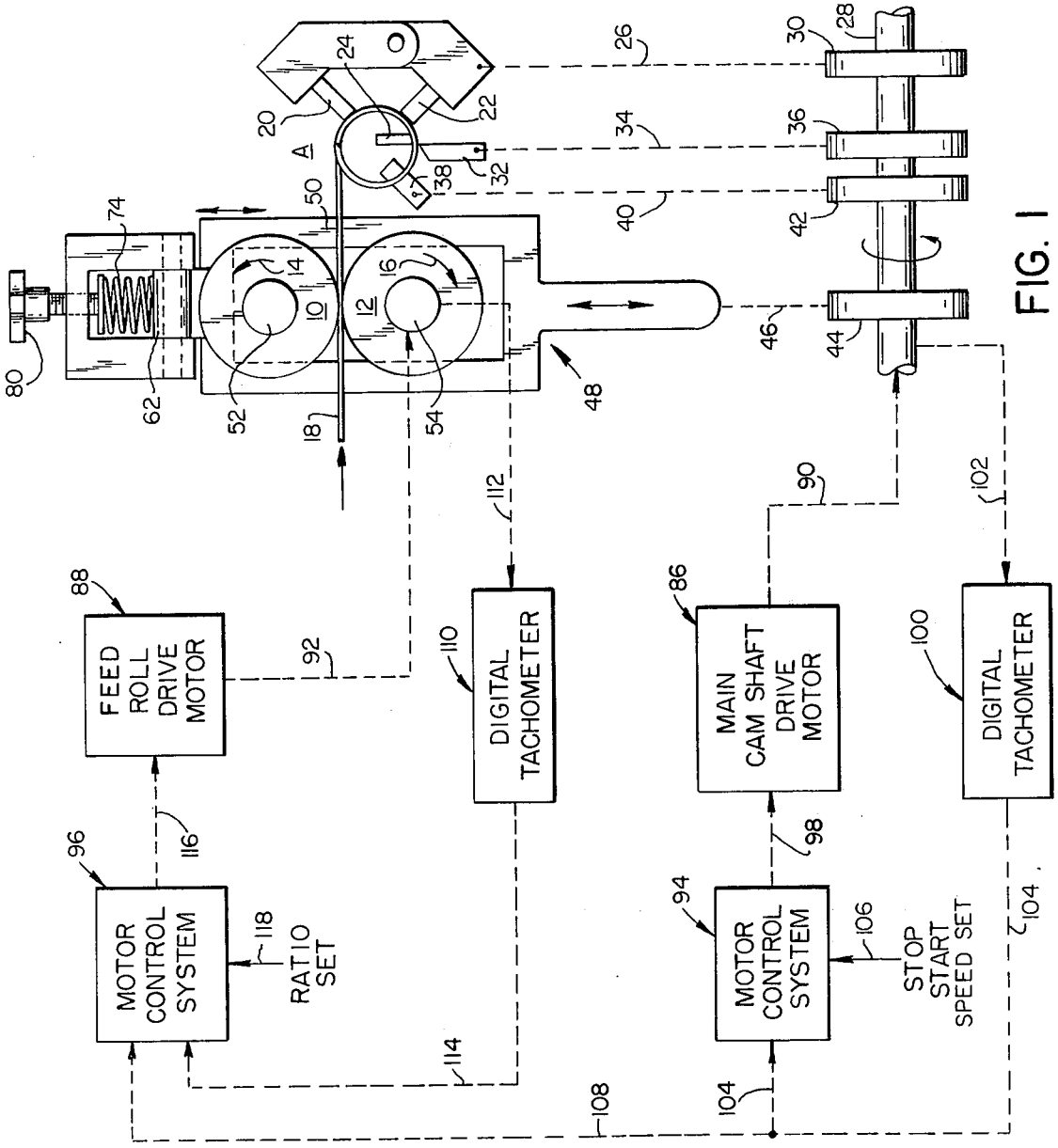
FIG. 1 of the drawing is a schematic illustration of the spring coiling machine and improved drive means of the present invention, and includes a somewhat schematic illustration of a means for terminating wire advancement at the end of each wire feeding operation.

Referring particularly to FIG. 1 in the drawing, it will be observed that a pair of feed rolls are provided in upper-lower relationship at 10, 12. The rolls 10, 12 are geared to rotate in opposite directions as indicated by the arrows 14, 16 and to grip and advance a length of wire 18 longitudinally from left to right in the drawing. The wire 18 may vary widely incross sectional configuration and may pass through conventional straightening devices, not shown, prior to tis introduction to the feed rolls. A source of wire supply for the straightening devices and feed rolls may be in the form of a large coil mounted for free rotation.

As is more fully explained and illustrated in one or more of the above-listed patents, wire feed is intermittent and integral leading end portions of the wire such as 18 are successively advanced from left to right in FIG. 1 to a coiling station A where the leading end portions are successively engaged and obstructed in their movement by one or more coiling tools or abutments. In the schematic illustration of FIG. 1, a "dual point" coiling tool system is employed and the wire 18 is engaged and obstructed in its movement by upper and lower coiling tools 20, 22. The coiling tools 20, 22 are angularly displaced and are movable generally radially toward and away from the wire 18 during certain coiling operations. Thus, the tools may be controlled in their movement during coiling by conventional motion transmitting means more fully described and illustrated in the above patents and particularly in U.S. Pat. No. 3,934,445. The said motion transmitting means, indicated by broken line 26 may be operated from a main camshaft in the spring coiling machine indicated generally at 28. Thus, a cam 30 on the camshaft 28 may be regarded as a "coiling tool cam".

During each cycle of machine operation and, more particularly, at the completion of each coiling operation, it is of course necessary to sever the integrally connected spring from the forward end of the wire 18. Accordingly, a conventional cut-off tool 32 is provided and is operated by a conventional motion transmitting means indicated by broken line 34. A "cut-off cam" 36 operates the motion transmitting means from the camshaft 28 whereby to provide the necessary timed relationship between coiling and cut-off operations.

A pitch tool is also conventional in spring coiling machines and operates to engage the spring during its formation at the coiling station A and to urge each coil forwardly in FIG. 1 whereby to provide the desired pitch. Such a tool is indicated generally by the reference numeral 38 and it will be apparent that pitch tool movement during spring formation may be desired to provide springs of varying pitch throughout their length. Accordingly, a motion transmitting means indicated generally by broken line 40 is connected between the pitch tool 38 and a "pitch tool cam" 42 mounted on and rotatable with the camshaft 28.

Figure 2:
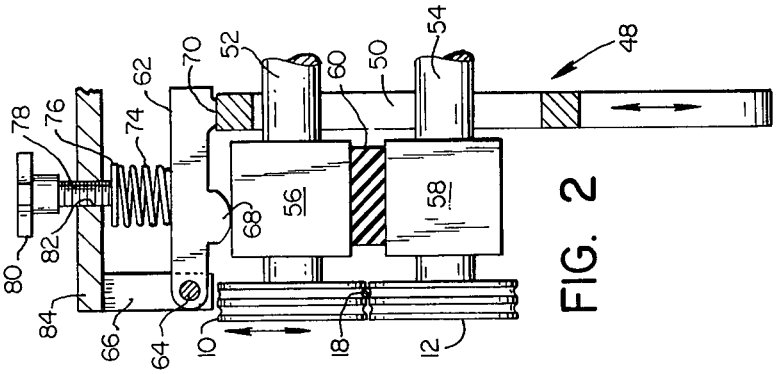
FIG. 2 is a somewhat schematic side elevation of the means for terminating wire advancement.

While intermittent feed roll rotation is the norm in prior art spring coiling machines, the present invention contemplates continuous feed roll rotation with the wire feed operation intermittently terminated by other means. That is, a means for terminating wire advancement is incorporated in the machine separate and apart from the feed roll drive means and the drive means is permitted to rotate the rolls continuously with the rolls being intermittently rendered inoperative to feed wire. The means for terminating wire advancement includes a cam 44 mounted on and rotatable with the camshaft 28 and a conventional motion transmitting means indicated by broken line 46 and connected between the cam and a slide indicated generally at 48. The slide 48, includes a yoke 50 which extends upwardly on opposite sides of upper and lower feed roll drive shafts 52, 54 as best illustrated in FIG. 2. Upper and lower bearing housings or boxes 56, 58, respectively movable and stationary, are provided for the shafts 52, 54 and the feed rolls 10, 12. The bearing housings or boxes 56, 58 are disposed in vertically adjacent but spaced relationship and a resilient member 60 is disposed therebetween and urges the same apart and in a direction tending to terminate wire gripping action of the feed rolls. The drive shaft 52 for the upper feed roll 10 is mounted at a right hand end portion, not shown, in a conventional bearing of the type which allows a slight angular misalignement of the shaft at its left hand end portion shown. That is, the bearing box or housing 56, the feed roll 10 and the left hand end portion of the shaft 52 are subject to slight vertical or, more precisely, arcuate up and down swinging movement.

A lever 62 disposed atop the upper bearing box 56 is pivotally supported as by means of a pivot pin 64 in a machine frame part 66 and has a first downwardly projecting lug 68 which engages the top of bearing box 56. At its right hand and free end the lever 62 has a second small lug 70 which engages an upper end portion of the aforementioned yoke 50, forming a part of the slide 48. Seated on an upper surface of the lever 62 is a biasing means in the form of a coil spring 74 which has a manually adjustable upper seat 76. The upper seat 76 may comprise a small disc formed at a lower end portion of an adjustment bolt 78 provided with a manually manipulable knob 80. The bolt 78 is threadably received in a suitable opening 82 in a machine frame member 84 which extends horizontally above the lever 62.

As will be apparent from the foregoing, the biasing means or spring 74 urges the lever 62 downwardly in turn maintaining engagement between the lug 68 and the bearing box 56 and overcoming the opposing force of the resilient member 60 and the wire 18 engaged between the feed rolls 10, 12. The gripping action of the feed rolls 10, 12 on the wire is thus maintained during a wire feeding operation. When it is desired to terminate wire feed and at a selected angular position of the camshaft 28, the cam 44 operates to actuate the motion transmitting means 44 and to urge the slide 48 upwardly through a slight increment of movement. Upward movement of the slide acts through the lug 70 and the lever 62 to slightly compress the spring 74 and to thus relieve the downward biasing force of the spring on the upper bearing box 56. The upwardly directed opposing forces of the wire 18 and the resilient member 16 thereupon become predominant effecting a sharp and precise loss of wire gripping action by the feed rolls and a resulting termination of wire advancement, the feed rolls thus being allowed to rotate continuously but inoperatively between intermittent feeding operations.

Referring now to the improved drive means of the present invention, and to an illustrative example thereof, it will be observed that first and second electric drive motors are illustrated in block diagram form respectively at 86, 88 in FIG. 1. The motors 86, 88, respectively drive the camshaft 28 through conventional means indicated generally by broken line 90 and the feed rolls 10, 12 again through conventional means indicated by broken line 92. As mentioned above, the feed rolls 10, 12 are geared together for opposite rotation of their respective drive shafts 52, 54. The electric motors 86, 88 are of a precise and fast response type but may vary widely in form. In the present illustrative example, the camshaft motor 86 is of the permanent magnet DC type and may comprise an Indiana General Model No. 4560 3/4 (three-fourths) horse power motor. The feed roll drive motor 88 is also of the permanent magnet DC type and may take the form of an Indiana General 1 ½ (one and one-half) horse power Model No. 6557. Control of motor speed in each instance is exercised through control of armature input voltage.

Control circuitry for the first and second or camshaft and feed roll drive motors 86, 88 includes conventional controls for each of the motors illustrated in block diagrams form respectively at 94, 96. That is, a first motor control system 94 operatively associated with the camshaft drive motor 86 is shown connected with the motor by broken line 98. The motor control system 94 may vary substantially in form but in the present illustrative example of the invention a single quadrant type control system employing SCR power circuitry is employed and may comprise a Motor Control Model No. MC131 Size D manufactured by the Digital Systems Division of Detection Sciences Inc., Minneapolis, Minn.

A transducer is provided to supply a speed feedback signal from the camshaft to the motor control system 94 and may take the form of a digital tachometer indicated generally in block diagram form at 100 and connected respectively with the camshaft 28 by broken line 102 and with the motor control system 94 by broken line 104. Stop, start, and speed set or selection inputs are also supplied to the motor control system 94 as indicated by arrow 106 and, in accordance with the presently preferred practice, a speed set or selection input signal is provided in analog form by a manual input potentiometer included in the motor control system 94.

The MC131 motor control system includes integrating circuitry for receiving the digital feedback signal from the tachometer 100 through line 104 and for converting the same to a proportional analog signal. Further, and in accordance with conventional practice, comparison and amplifying circuitry is included in the control system and receives the converted signal from the integrating circuitry as well as the analog speed set or selection signal from the potentiometer. The speed of the camshaft drive motor 86 and the camshaft 28 is thus established and maintained precisely at selected levels of RPM merely by manually setting the potentiometer in the motor control system 94.

The camshaft speed feedback signal of the line 104 is also supplied to the motor control system 96 for the feed roll drive motor 88. Further, a feed roll speed feedback signal is provided to the motor control system 96 by a transducer in the form of a digital tachometer 110 connected with the feed rolls by broken line 112 and with the motor control system by broken line 114. The motor control system 96 is connected with the feed roll drive motor 88 as illustrated schematically by broken line 116 and is also provided with a ratio set or selection input signal as indicated by the arrow 118. As in the case of the motor control system 94 a manually manipulable potentiometer may be employed as a ratio set or selection means.

The motor control system 96 may take a conventional form in the present illustrative example and a single quadrant type control with SCR power circuitry is employed in the form of a Model No. TF131 motor control unit with ratio control. The unit may be purchased from the Digital Systems Division of Detection Sciences Inc., of Mineapolis, Minn. Integrating circuitry is included for receiving the input signals from the digital tachometer 100 through line 108 and from the digital tachometer 110 through line 114 and for converting the signals to proportional analog signals. Comparison and amplifying circuitry in the motor control system receives the converted signals together with a ratio set or selection signal in analog form from the potentiometer in the control system. The feed roll drive motor is thus controlled to establish and to maintain selected speed ratios between the two motors and between the feed rolls 10, 12 and the camshaft 28. Precise follower operation of the feed roll drive motor is achieved with a high degree of repeatability. Moreover, ratio set or selection is accomplished merely by manually dialing in a desired or selected speed ratio.

It is also contemplated within the scope of the invention that a regenerative or four quadrant type control system be utilized in an arrangement similar to that described above with a feedback signal from the camshaft motor serving as an input to a motor control system for the feed roll motor and with ratio set or selection introduced at the feed roll motor control system as, for example, by adjusting gain in the motor control system. Control elements in such a system may comprise a Control Systems Research Model No. NC121F motor control with a compatible electric motor driving the camshaft and a Control Systems Research Model No. NC122 motor control with a second compatible electric motor driving the feed rolls. In such event, analog type speed transducers would be substituted for the digital tachometers 100 and 110.

From the foregoing, it will be apparent that a high degree of flexibility and versatility is provided for in the operation of a spring coiling machine with the improved drive means of the present invention. Motor speed ratios are variable over a substantially broader range than has heretofore been possible with mechanical spring coiler drive means and, accordingly, a wide range of wire feed lengths is available. Feed length is not severely limited by wire diameter or other cross sectional characteristics. There is no necessity to employ change gears and setup operation is greatly simplified and expedited in merely dialing in speed and ratio selection. Severe limitations on the respective portions of the machine cycle to be employed in coiling and cut off are avoided. Both speed and ratio selection can be accomplished "on the run". Finally, a high degree of accuracy and repeatability is achieved in operation of the spring coiling machine with the improved drive means of the present invention.

We claim:

1. In a spring coiling machine, the combination of at least one pair of feed rolls for intermittently longitudinally advancing an elongated length of wire from a source of supply whereby successively to feed integral leading end portions thereof to a coiling station, at least one coiling tool at said station arranged to engage said successively advanced leading end portions and to obstruct feed movement thereof whereby progressively to coil the same into springs, at least one cut-off tool at said coiling station operable successively to sever the springs at the termination of said coiling operations, a rotary camshaft and associated operating means for said coiling and cut-off tools, a drive means for said camshaft comprising a first electric motor connected with the camshaft and operable to effect continuous rotation thereof, a drive means for said feed rolls comprising a second electric motor connected with the rolls and operable to effect continuous rotation thereof, electrical control means including speed ratio selection and maintenance means connected with said two motors and adapted initially to accommodate manual motor speed ratio selection and thereafter to maintain automatically and precisely selected ratios of motor speed, and means separate from said second electric motor connected with said feed rolls and with said camshaft and operable in response to the latter successively to terminate wire advancement by said feed rolls in timed relationship with the operation of said coiling and cut-off tools.

2. The combination in a spring coiling machine as set forth in claim 1 wherein said electrical control means includes first and second motor control systems connected respectively with said first and second electrical motors, and wherein a first feed back transducer is provided to supply a signal from said first electrical motor to said second motor control system whereby to cause said second motor to follow said first electrical motor and to maintain said selected motor speed ratios.

3. The combination in a spring coiling machine as set forth in claim 2 wherein said second motor control system is provided with a ratio selection means adapted for manual manipulation.

4. The combination in a spring coiling machine as set forth in claim 3 wherein said ratio selection means includes a potentiometer.

5. The combination in a spring coiling machine as set forth in claim 3 wherein said first motor control system is provided with a speed selection means adapted for manual manipulation.

6. The combination in a spring coiling machine as set forth in claim 5 wherein said selection means includes a potentiometer.

7. The combination in a spring coiling machine as set forth in claim 2 wherein said electrical control means includes first and second motor control systems connected respectively with said first and second electric motors, wherein a first transducer is provided to supply a speed feedback signal from said camshaft to each of said first and second motor control systems, wherein a ratio selection means is provided in said second motor control system to introduce a selected motor speed ratio signal, and wherein said second motor control system includes signal comparison and amplifying circuitry for varying the speed of said second electric motor in response to changes in said feedback signal whereby to maintain a fixed speed ratio relationship between said two electric motors.

8. The combination in a spring coiling machine as set forth in claim 7 wherein said transducer is adapted to provide a digital speed feedback signal, and wherein said second motor control system includes integrating circuitry for receiving said signal and converting the same to an analog signal for introduction to said comparison and amplifying circuitry.

9. The combination in a spring coiling machine as set forth in claim 8 wherein a second transducer is provided and adapted to supply a digital feedback signal from said feed rolls to said integrating circuitry in said second motor control system.

10. The combination in a spring coiling machine as set forth in claim 9 wherein said ratio selection means includes a potentiometer for supplying an analog signal of selected speed ratio to said signal comparison and amplifying circuitry in said second motor control system.

11. The combination in a spring coiling machine as set forth in claim 9 wherein said first motor control system includes integrating circuitry for receiving said feedback signal from said first transducer and for converting the same to an analog signal, wherein said first motor control system includes manually manipulable speed selection means supplying an analog signal of selected motor speed, and wherein said first control system also includes signal comparison and amplifying circuitry for receiving said two signals and for establishing and maintaining speed of said first electric motor at selected levels.

12. The combination in a spring coiling machine as set forth in claim 11 wherein said speed selection means includes a potentiometer having a manual speed selection input.

13. The combination in a spring coiling machine as set forth in claim 1 wherein said means for terminating wire advancement includes mechanical motion transmitting means connected between said camshaft and at least one of said feed rolls and operable in response to camshaft rotation through a selected angular position to effect movement of said one feed roll laterally away from the other feed roll whereby to terminate gripping action of the two rolls on the wire and to accommodate continued but inoperative rotation of said rolls.

14. The combination in a spring coiling machine as set forth in claim 13 wherein said motion transmitting means includes a cam and follower mechanism associated with said camshaft and a slide operated thereby and connected with said one feed roll to effect said lateral movement thereof in timed relationship with the aforesaid coiling and cut-off operations.

15. The combination in a spring coiling machine as set forth in claim 14 wherein said means for terminating wire advancement also includes biasing means urging said one feed roll in opposition to said slide and into wire gripping engagement with said other feed roll.

16. The combination in a spring coiling machine as set forth in claim 15 wherein said biasing means comprises a coil spring, and wherein a manually adjustable seat is provided therefor.

17. The combination in a spring coiling machine as set forth in claim 16 wherein said wire advancement terminating means also includes a lever partially disposed between said spring and a bearing housing for said one feed roll, said lever being pivotally supported and connected with and pivotally operated from said slide whereby to compress said spring and to relieve spring biasing pressure on said feed roll bearing housing.

18. The combination in a spring coiling machine as set forth in claim 17 wherein each of said feed rolls is provided with a bearing housing, said housings being in adjacent but spaced relationship, and wherein a resilient means is provided between and in operative association with said housings, said resilient means tending to urge said housings apart whereby to effect termination of the wire gripping action of the rolls.

* * * * *